US005336110A

United States Patent [19]

Mosquera

[11] Patent Number: 5,336,110

[45] Date of Patent: Aug. 9, 1994

[54] PEG HELD CONNECTOR

[75] Inventor: Rene A. Mosquera, Laguna Niguel, Calif.

[73] Assignee: ITT Corporation, Secaucus, N.J.

[21] Appl. No.: 700,140

[22] PCT Filed: Oct. 15, 1991

[86] PCT No.: PCT/US91/07602

§ 371 Date: Nov. 12, 1991

§ 102(e) Date: Nov. 12, 1991

[87] PCT Pub. No.: WO93/08619

PCT Pub. Date: Apr. 29, 1993

[51] Int. Cl.[5] ..... H01R 13/74

[52] U.S. Cl. ..... 439/554; 439/572

[58] Field of Search ..... 439/544, 559, 572, 560, 439/564, 82, 620

[56] References Cited

U.S. PATENT DOCUMENTS

| | | | |
|---|---|---|---|
| 2,853,913 | 9/1958 | Rapata | 85/5 |
| 3,240,100 | 3/1966 | Rose | 85/19 |
| 4,076,356 | 2/1978 | Tamburro | 339/17 |
| 4,195,900 | 4/1980 | Hughes | 339/125 |
| 4,435,031 | 3/1984 | Black et al. | 339/17 |
| 4,477,142 | 10/1984 | Cooper et al. | 339/125 |
| 4,691,971 | 9/1987 | Hahn | 439/78 |
| 4,691,979 | 9/1987 | Manska | 439/82 |
| 4,726,638 | 2/1988 | Farrar et al. | 439/620 |
| 4,740,166 | 4/1988 | Barnhouse | 439/82 |
| 4,776,807 | 10/1988 | Triner et al. | 439/82 |
| 4,907,987 | 3/1990 | Douty et al. | 439/571 |
| 5,002,507 | 3/1991 | Sitzler | 439/751 |

*Primary Examiner*—Eugene F. Desmond

*Attorney, Agent, or Firm*—Thomas L. Peterson

[57] ABSTRACT

A connector is described, of the type that has pegs for insertion in holes of a circuit board to securely hold the connector to the board, wherein the pegs can be easily installed, and they assure secure holding despite variations in circuit board thickness and moderate tolerances in the diameters of the circuit board holes. Each of the pegs (41, FIG. 4 ) has a peg body (60) with an axis (62), and a plurality of ribs (71–73) projecting radially outwardly from the periphery of the body. The pegs are constructed of material of lower hardness than the material of the circuit board, so the interference fit between the pegs and circuit board results in flattening of the tips of the ribs and/or shaving of the tips of the ribs. Each peg has a slot (66) extending from the periphery of the peg body to near the axis of the peg body, and a pair of the ribs lie on opposite sides of the slot, so radially-inward pressure on the ribs causes the slot to close slightly and allow the ribs to move radially inwardly. The slots of adjacent pegs are oriented so they are turned 90° from each other to reduce the insertion force and the possibility of peg breakage.

14 Claims, 5 Drawing Sheets

FIG. 9
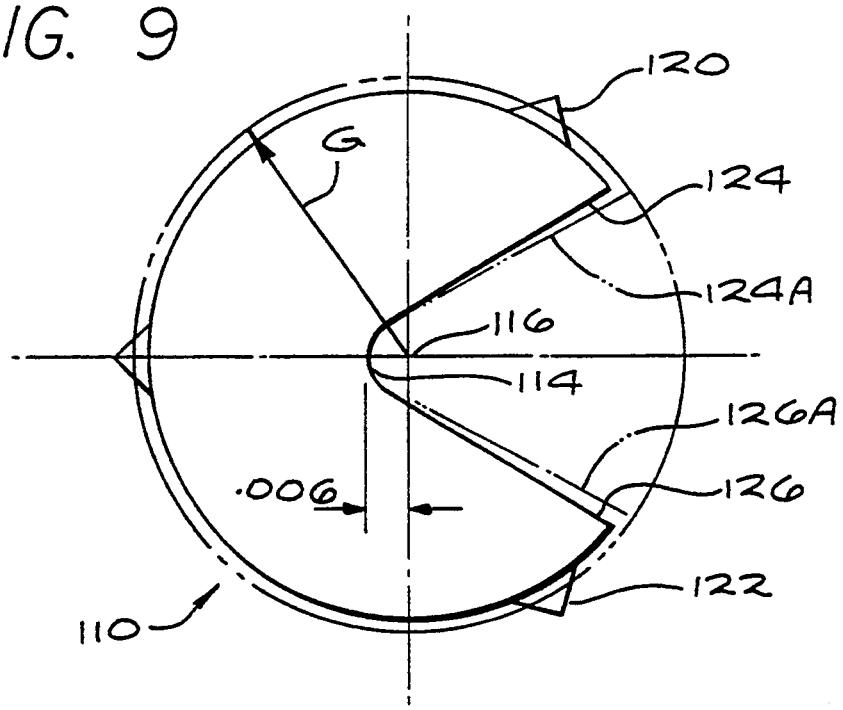
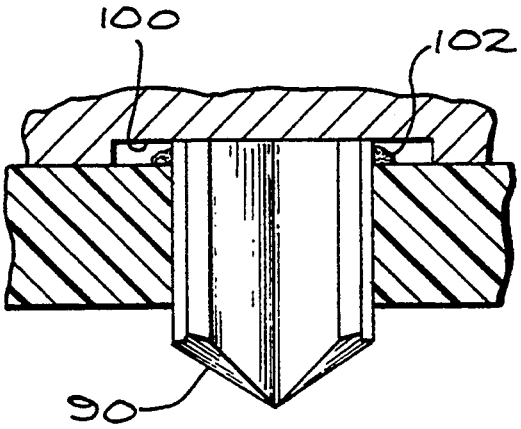
FIG. 10
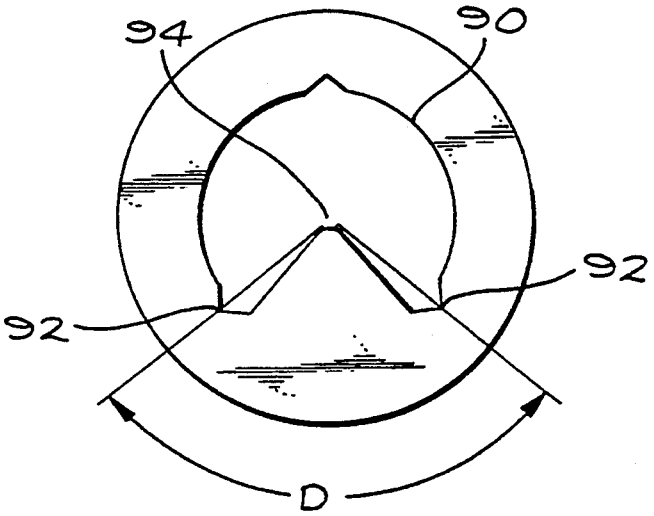
FIG. 11

PEG HELD CONNECTOR

BACKGROUND OF THE INVENTION

One type of connector designed to mount on a circuit board, includes a group of downwardly-depending pegs which fit into holes drilled into the circuit board. When the pegs have been fully inserted through the top surface of the circuit board and project through the bottom surface, the bottom of the pegs are heat deformed into a mushroom shape to trap the pegs in the board and thereby hold the connector in place during subsequent soldering of connector contacts to plated-through holes of the board and afterwards. Such heat-staked pegs involve time-consuming operations in melting the bottoms of the peg, and can be unreliable because the holding power of the pegs depends on the thickness of the circuit board, and the pressure and temperature applied to the pegs during their deformation. A peg arrangement which enables secure holding of a connector to a circuit board or other board-like device, which avoided the need for heat staking the pegs while assuring reliable holddown of the connector, would be of considerable value.

SUMMARY OF THE INVENTION

In accordance with one embodiment of the present invention, a connector is provided that has pegs for installation in holes of a circuit board or the like, which facilitates installation and assures reliable holding of the connector to the board. Each peg has a peg body with an axis, and has ribs extending radially outwardly from the body for interference fit in a board hole. Each peg also has a slot extending radially inwardly from the body to near or beyond the axis of the peg, and has a pair of ribs on opposite sides of the slot, so the ribs can deflect to a smaller radius by slight closing of the slot. The circuit board is of harder material than the pegs and a recess is provided around the upper end of each peg to receive debris shaved from the ribs when they are pressed into a hole where there is large interference. Adjacent pegs are oriented with their slots turned at least 45° from one another, to minimize stress and possible breakage of the pegs.

The novel features of the invention are set forth with particularity in the appended claims. The invention will be best understood from the following description when read in conjunction with the accompanying drawings.

BRIEF DESCRIPTION OF THE DRAWINGS

FIG. 9 is an end view of a peg constructed in accordance with another embodiment of the invention.

FIG. 10 is a sectional side view of a portion of a connector with its peg inserted into a circuit board hole, constructed in accordance with another embodiment of the invention.

FIG. 11 is an end view of the peg of FIG. 10.

DESCRIPTION OF THE PREFERRED EMBODIMENTS

Figure 1:
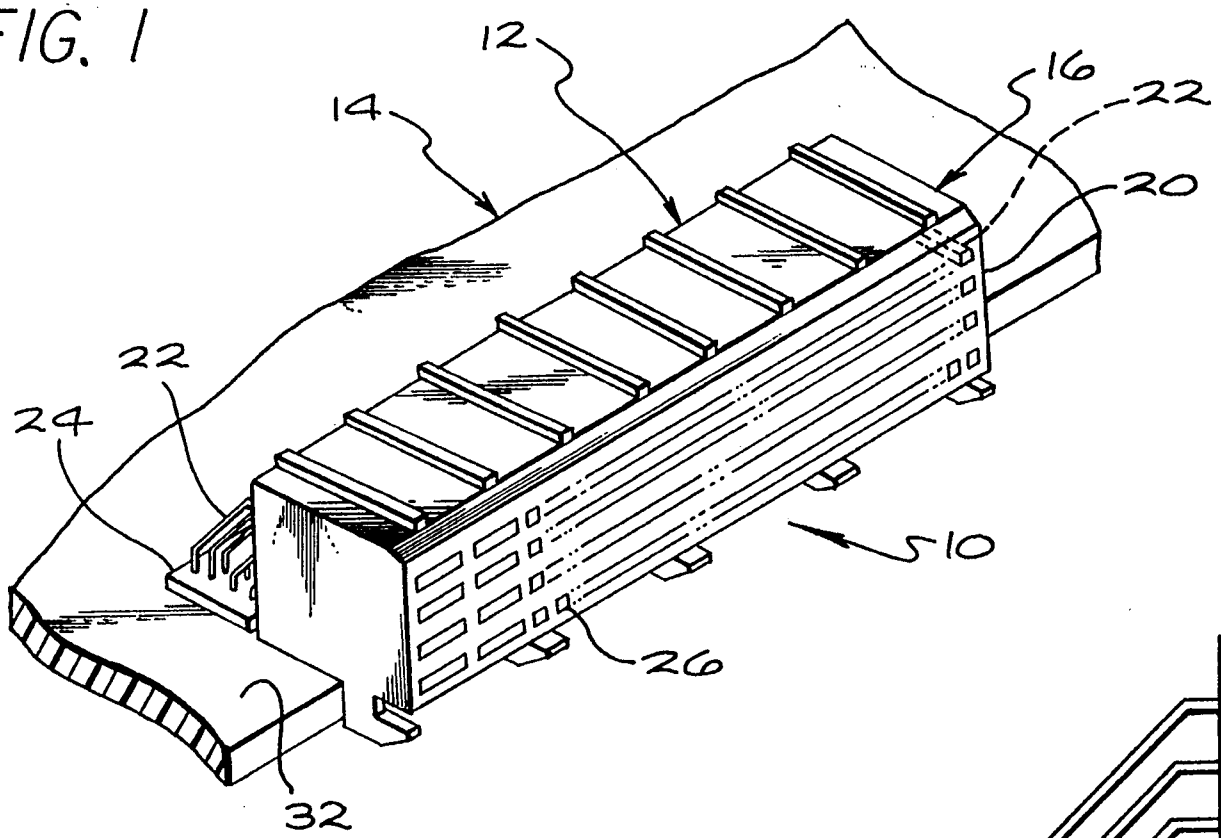
FIG. 1 is a top and side isometric view of a connector of the present invention, showing it fully installed on a circuit board, with only a portion of the circuit board being shown.
Figure 2:
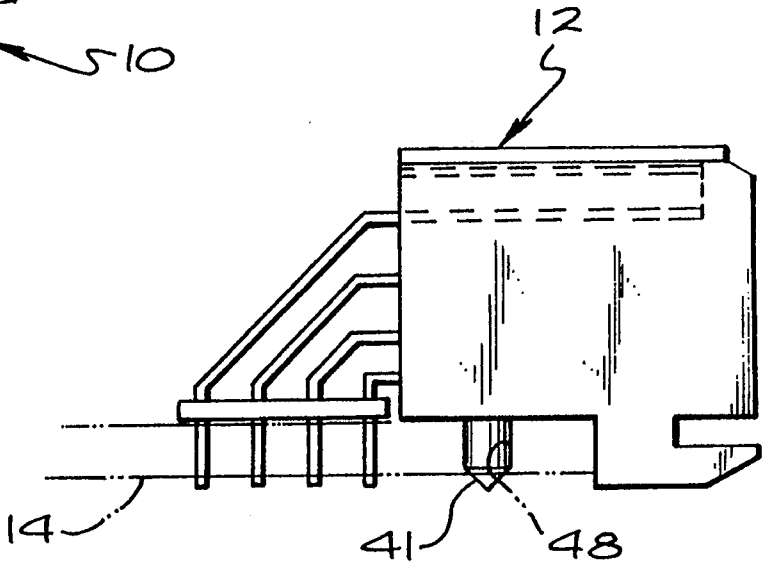
FIG. 2 is a side elevation view of the connector of FIG. 1, with the circuit board being shown in phantom lines.

FIG. 1 illustrates a combination or system 10 that includes a connector 12 mounted on top of an edge portion of a circuit board 14. The connector has a housing 16 with a main housing portion 20 that contains socket contacts 22, the contacts extending from the main housing portion and through a support plate 24 into plated-through holes of the circuit board. The connector is designed to mate with another connector having pins that enter socket holes 26, to connect contacts of the other connector to traces on the circuit board. Although terms such as "upper", "lower", "horizontal", "depending", and the like will be used to aid in the description of the invention, it should be understood that the parts can be used in any orientation with respect to gravity.

Figure 3:
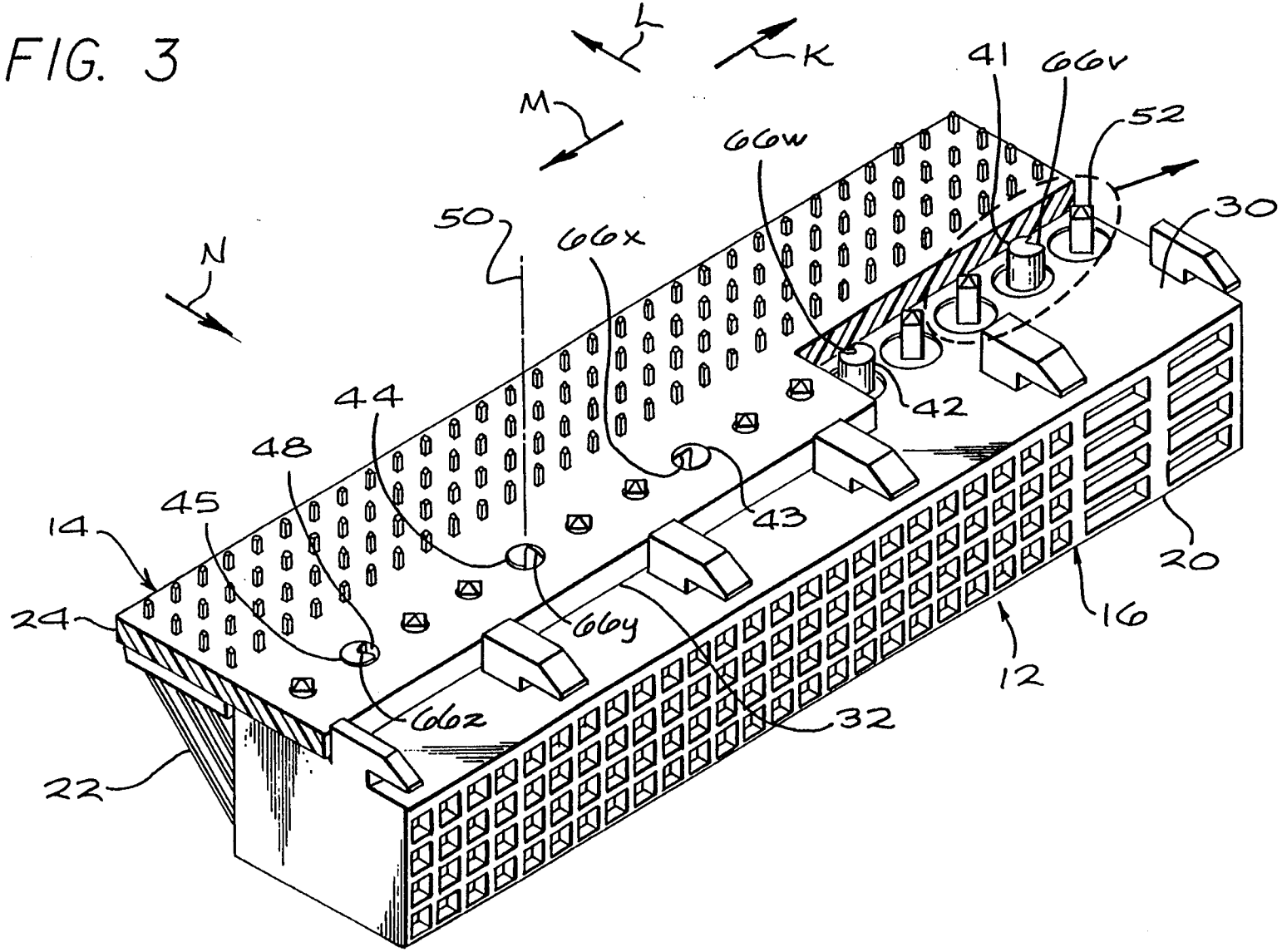
FIG. 3 is an upside-down isometric view of the assembly of FIG. 1, with much of the circuit board being cut away.

As shown in FIG. 3, the main housing portion 20 has a board-engaging surface 30 which is designed to lie substantially facewise adjacent to an upper surface 32 of the board. A group of five pegs 41–45 depend from the main housing portion, and are designed to be received in holes 48 in the circuit board. The peg-receiving holes 48 have been drilled in the circuit board and therefore are round in that each has a round cross section when viewed from the top of the board along the axis 50 of the hole. The connector also has a group of locating pins 52 which fit into smaller pin-receiving holes and lie in slight interference fit with the walls of the holes, to aid in accurately locating the connector with respect to the circuit board. However, the pegs such as 41 provide a much greater interference fit with the holes to securely hold the connector in place during subsequent wave-soldering of the contacts 22 to the board and afterwards.

Figure 4:
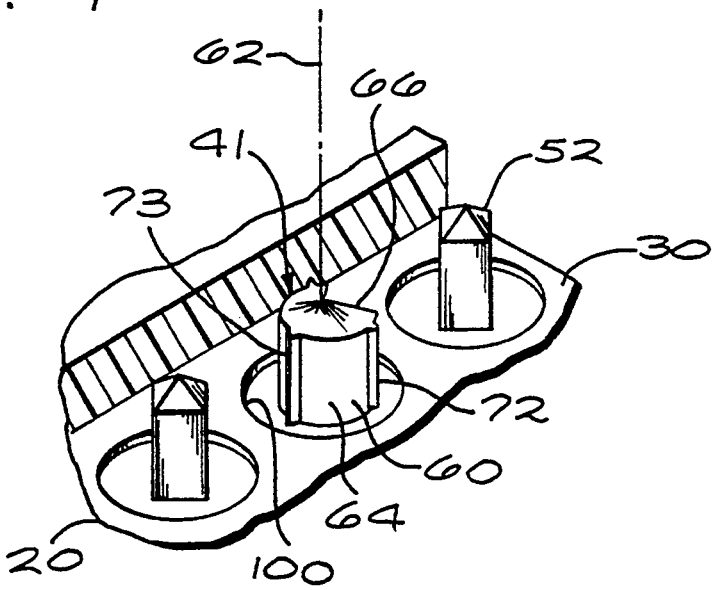
FIG. 4 is an isometric view of a portion of the assembly of FIG. 4.

As shown in FIG. 4, each peg such as 41 includes a peg body 60 having a peg body axis 62, with the body having a largely cylindrical periphery 64. A slot 66 projects into the periphery of the body and extends to near the peg axis 62. The peg also includes three ribs 71–73 projecting radially outwardly (with respect to the peg axis 62) from the body. The peg is solid, in that it is completely filled with molded plastic material rather than being constructed as a hollow shell.

Figure 5:
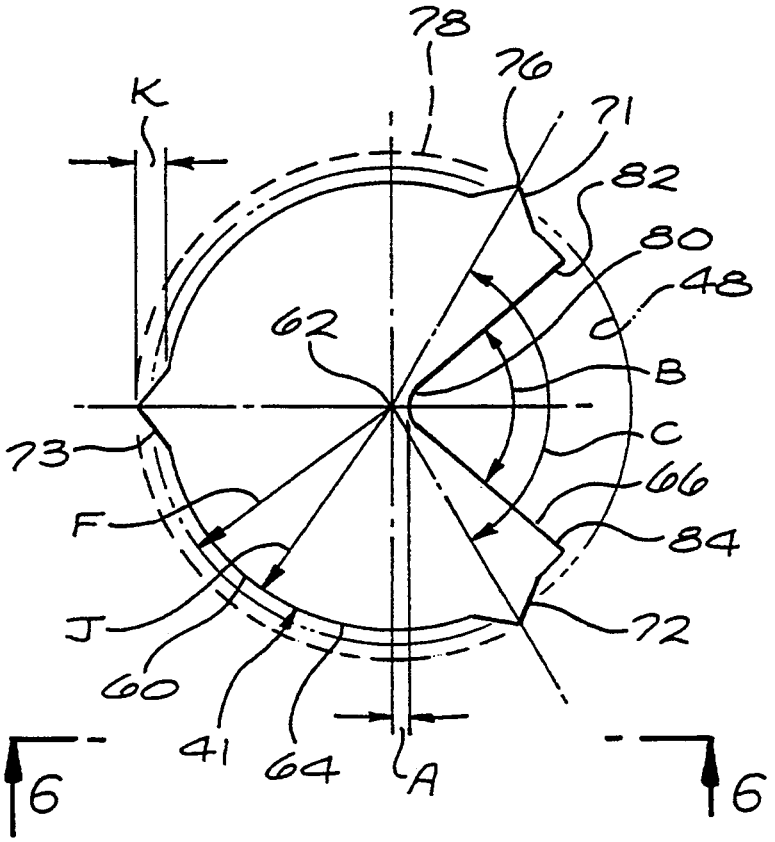
FIG. 5 is an end view of the peg of FIG. 4.
Figure 6:
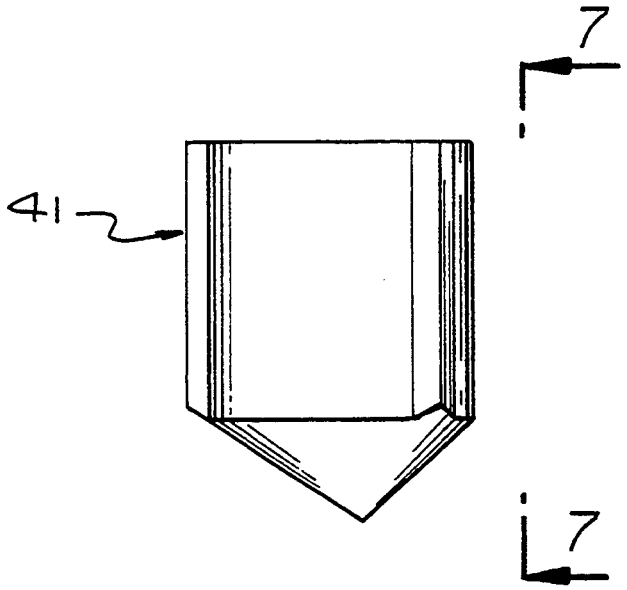
FIG. 6 is a view taken on the line 6—6 of FIG. 5.
Figure 7:
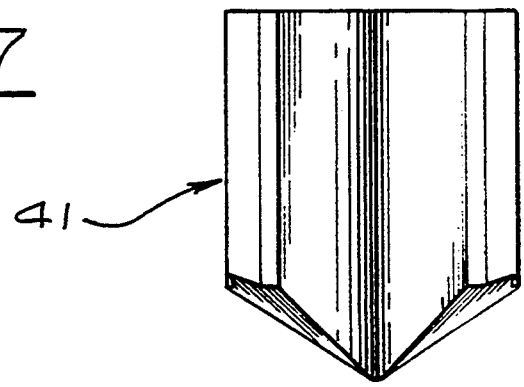
FIG. 7 is a view taken on the line 7—7 of FIG. 6.

As shown in FIG. 5, the undeformed edges or tips 76 of the ribs lie on an imaginary circle 78, as seen in an end or plan view of the pegs taken along the peg axis 62. This imaginary circle 78 is of somewhat greater diameter than the diameter of the peg-receiving hole 48 in the circuit board into which the peg fits. As a result, there is a considerable interference fit between the peg and board hole, requiring substantial force to insert the pegs into the holes. The circuit board and the walls of its peg-receiving holes are commonly constructed of phenolic thermosetting plastic, while the pegs may be molded of a much softer thermoplastic. As a result, when a peg is forced into a hole, its ribs are deformed and/or shaved, with the first and second ribs 71, 72 on opposite sides of the slots 66, being deflected slightly together.

Applicant forms the slot 66 so it extends along most of the radius of the peg body to lie close to the peg axis 62. The distance A between the radially innermost slot location 80 and the peg axis 62 is preferably small, and may be negative (where the slot extends beyond the peg axis 62, as in the case of the peg shown in FIG. 9). Applicant places the first and second ribs 71, 72 on opposite sides of the slot 66, and close enough thereto so that radially inward forces on the ribs 71, 72 by the walls of the circuit board hole 48 cause the ribs to deflect with radially-inward directional components, which result in slight closing of the slot. Applicant prefers to provide a tapered slot 66 which is generally progressively wider at locations progressively further from the innermost slot location 80 (and from the axis 62 for the slot of FIG. 5). The slot 66 has a taper angle B of about 80°. This provides relatively high resilience for a peg of material of moderately low rigidity.

Figure 8:
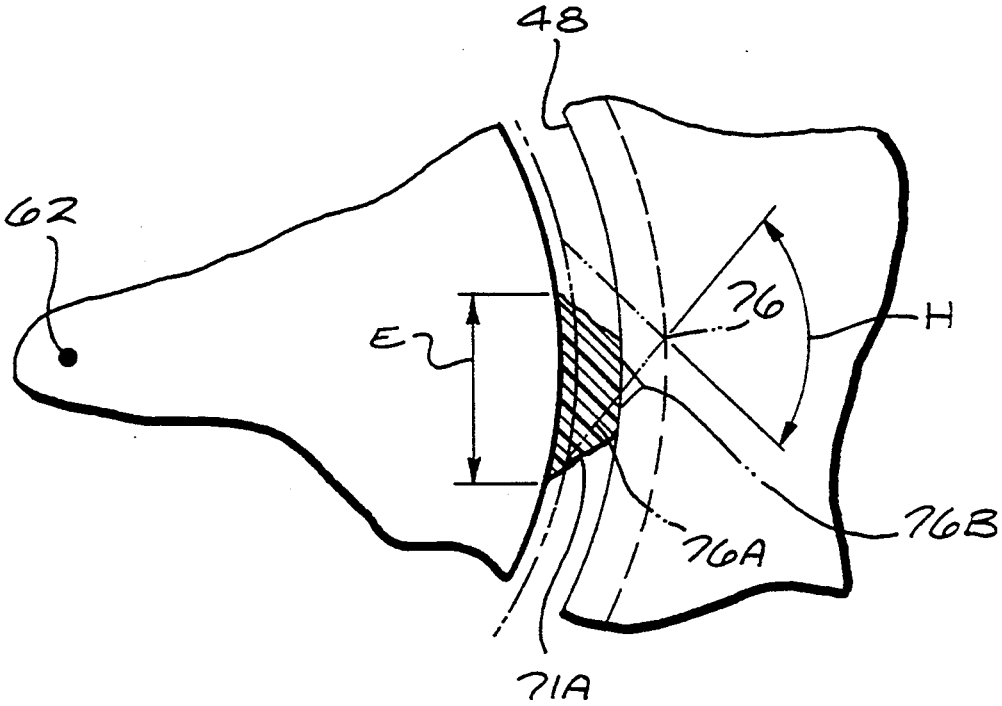
FIG. 8 is an enlarged view of a portion of the peg of FIG. 5, but showing it deformed in a circuit board hole.

The tips 76 of the ribs 71, 72 are angled apart by an angle C of about 120° and preferably no more than 140°. Such angling of the rib tips allows the radially-inward forces applied to the tips to create a considerable force tending to close the slot and allowing the tips to move with a radially inward component. For example, tip 76 (FIG. 8) on deformed rib 71A may move towards a location 76A where the undeformed rib would lie on the circle forming the peg-receiving hole. FIG. 8 illustrates a case where the rib tip 76 has been deflected from the position 76 to the position 76B, and also has been deformed, to fit within the walls of the hole 48 in the circuit board. The undeformed tip is tapered along most of its length by an angle H of 95°. A taper angle of at least about 90° is preferred to avoid bending-over of the rib when sideward forces are applied to it.

It would be possible to move the ribs 71, 72 so their tips lay closer to the opposite sides 82, 84 of the slot. FIG. 11 shows a peg 90 where the angle D between the tips 92 of ribs at opposite sides of the slot are angled by about 100° from the axis 94 of the peg. However, such placement of the rib tips does not necessarily increase the force tending to compress the slot. In many applications, applicant finds that it is desirable to place the ribs so their tips are spaced from opposite sides of the slot, with the spacing often being more than one half the base width E of each rib, and preferably at least 100° but no more than about 120°.

As shown in FIG. 4, applicant prefers to provide a recess 100 around the end of each peg that is closest to the main housing portion 20, with a recess 100 lying above, or inward of the surface 30 of the main housing portion that lies adjacent to the upper surface of the circuit board in the fully installed position. The recess 100 is useful to receive any debris that has been shaved from the tips of the ribs during insertion of the peg into the circuit board hole. FIG. 10 indicates the presence of shavings at 102. Applicant forms the outer end of each peg, which lies furthest from the main housing portion, so it lies largely on a cone to facilitate insertion of each peg into a circuit board hole.

As shown in FIG. 3, the slots 66*v*–66*z* of the pegs 41–45 do not open or face in the same direction. The slot 66*v* opens or faces in a first horizontal direction K, the slot 66*w* of the adjacent peg 42 faces in a perpendicular horizontal direction L, the slot 66*x* faces in another perpendicular horizontal direction M, and the slot 66*y* faces in another perpendicular horizontal direction N. The last slot 66*z* faces in the direction K. The reason for orienting adjacent pegs with their slots turned 90° from each other, is to allow the pegs to more easily accommodate variations in spacing of the peg-receiving holes relative to the spacing of the pegs. Such variations can result from warping or shrinking of the circuit board or manufacturing tolerances. The rotation of subsequent pegs also aids in installing them in the holes in case the axes of all pegs or the axes of all holes do not extend in a straight line. The rotation of adjacent pegs results in the ribs of adjacent pegs not pressing in directly opposite directions. It is possible to rotate adjacent pegs by less than 90°, but preferably by at least 45° and more preferably by at least 60°.

FIG. 9 illustrates a peg 110 with a slot 112 whose radially innermost location 114 extends beyond the axis 116 of the peg body. This provides greater resilience, which may be necessary where the peg material is harder or the tolerances are greater. It can be seen that when the ribs 120, 122 on opposite sides of the slot are deflected, a slot closes so its walls 124, 126 are deflected to the positions 124A, 126A. It is desirable that the innermost slot locations such as 80 in FIG. 5 or 114 in FIG. 9 lie closer to the peg axis than one-half and preferably one-quarter (25%) of the radius F or G of the peg-receiving hole 48 in the circuit board in which the peg is designed to fit or the peg body periphery 60.

Applicant has constructed connectors of the type illustrated in FIGS. 1–8. Each peg had a largely cylindrical body of a diameter 2J of 74 mils (one mil equals one thousandth inch) and each rib extended a distance K of 5 mils beyond the cylindrical periphery of the body. Each peg-receiving circuit board hole 48 has a nominal diameter 2F of 80 mils, to provide for an interference fit of about 2 mils between each rib and the walls of the circuit board hole, in the ideal case. The tolerances of the parts was chosen so the radial interference between each rib and the hole walls was between one and four mils.

Thus, the invention provides a connector system wherein a connector has depending pegs for lying in holes of a board to securely hold the connector in place. Each peg has a body with an axis, the body having a slot extending radially inwardly from its periphery and having a plurality of ribs projecting radially outwardly from its periphery. A pair of ribs lies on opposite sides of the slot, so forces applied to the ribs during insertion tend to cause closing of the slot.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector which includes a connector housing having a plurality of depending pegs for insertion in hole walls forming substantially round holes in a circuit board or other board, where each hole has an axis, to hold the connector housing securely to the board, characterized by:

each of said pegs has an axis which can be substantially aligned with the axis of the board hole, a peg body with a periphery and a plurality of ribs extending radially outwardly from said body, and with said ribs extending far enough from said peg axis to form an interference fit with the walls of said board hole;

said peg body has a slot extending inwardly from said body periphery to near said axis, and first and second of said ribs lie on said body periphery near opposite sides of said slot and have radially outer parts that are angled apart by between about 100° and about 140° with respect to said axis, so radially inward forces on said ribs cause said slot to close and allow said ribs to move radially inwardly.

2. The connector described in claim 1 wherein:

said board holes each have a substantially round cross section;

said peg body is substantially solid in that substantially its entire volume is filled with molded plastic except for said slot, and said slot extends toward said peg axis sufficiently that the distance between the radially innermost slot location and said axis is no more than about 25 per cent of the radius of said board hole.

3. The connector described in claim 1 wherein:

each of said pegs is substantially solid in that substantially its entire volume is filled with solid material except for said slot, and said slot extends toward and substantially through and beyond said peg axis but occupies less than half of the volume of said peg.

4. A connector for mounting on a circuit board or other board that has a plurality of round holes, comprising:

a housing which includes a main housing portion with a lower surface, and a plurality of pegs projecting below said lower surface, each peg having a peg body with an axis and a plurality of ribs extending radially outwardly from body, with each rib having a radially outer tip lying on an imaginary circle as seen in a sectional view taken along said axis, and with said body being substantially solid, in that it is substantially completely filled with molded plastic material except at a slot, rather than being constructed as a hollow shell;

said slot lying at one side of said peg, with the innermost slot location lying close to said axis so it lies within 25 per cent of the radius of said imaginary circle to said axis, and said ribs include a rib on either side of said slot so the ribs can be deflected at least partially radially inwardly by partial closing of said slot.

5. The connector described in claim 4 wherein:

said slot is generally of progressively greater width at more radially outward locations.

6. The connector described in claim 5 wherein:

said slot is substantially wedge-shaped, with an included angle of at least 60°.

7. A board and connector combination comprising:

a circuit board having first and second opposite faces and having walls forming a plurality of peg-receiving holes of round cross-section;

a connector mounted in a fully installed position on said circuit board, said connector having a main housing portion with a lower surface lying substantially facewise against said first board face, and having a plurality of depending pegs lying in said circuit board holes;

each said peg including a peg body having a peg axis, having a slot, and having first and second ribs extending generally radially outwardly from said body, said first and second ribs lying on opposite sides of said slot and bearing against said walls of said circuit board hole, in said fully installed position of said connector.

8. The combination described in claim 7 wherein:

each said peg body is solid in that it is formed of molded plastic material that occupies substantially the entire volume of said peg body except for said slot, and said slot extends from an outermost location on the radial outside of said body to an innermost location that is spaced from said body axis by less than 25 per cent of the radius of said imaginary circle.

9. A method for forming and installing a connector having a lower surface and a plurality of pegs depending from said surface, in a circuit board having an upper surface and walls forming a plurality of round holes, characterized by:

forming each of said pegs with a peg body having a periphery and an axis, with a plurality of ribs extending radially outward from said body, with a slot in said body that extends largely radially from the outside of said body to near said axis, and with first and second of said ribs projecting from said periphery at locations near opposite sides of said slot;

pressing said pegs down into said peg-receiving holes with only said ribs bearing against the hole walls, while said first and second ribs deflect closer together and said slot narrows.

10. The method described in claim 9 including:

shaving the extreme radially outer tips of said ribs against said hole walls.

11. A connector which includes a connector housing having a plurality of depending pegs for insertion in hole walls forming substantially round holes in a circuit board or other board, where each hole has an axis, to hold the connector housing securely to the board, characterized by:

each of said pegs has an axis which can be substantially aligned with the axis of the board hole, a peg body with a periphery and a plurality of ribs extending radially outwardly from said body, with at least a portion of each of said ribs being tapered to be progressively narrower at more radially-outer positions, and with said ribs extending far enough from said peg axis to form an interference fit with the walls of said board hole;

said peg body has a slot extending inwardly from said body periphery to near said axis, and first and second of said ribs lie on said body periphery near opposite sides of said slot, so radially inward forces on said ribs cause said slot to close and allow said ribs to move radially inwardly;

said peg body periphery is largely cylindrical, and each of said ribs is tapered along most of its radial length by an angle of at least about 90°.

12. A connector which includes a connector housing having a plurality of depending pegs for insertion in hole walls forming substantially round holes in a circuit board or other board, where each hole has an axis, to hold the connector housing securely to the board, characterized by:

each of said pegs has an axis which can be substantially aligned with the axis of the board hole, a peg body with a periphery and a plurality of ribs extending radially outwardly from said body, and with said ribs extending far enough from said peg axis to form an interference fit with the walls of said board hole;

said peg body has a slot extending inwardly from said body periphery to near said axis, and first and second of said ribs lie on said body periphery near opposite sides of said slot and are angled apart by between 100° and 140°, so radially inward forces on said ribs cause said slot to close and allow said ribs to move radially inwardly.

13. A connector which includes a connector housing having a plurality of depending pegs for insertion in hole walls forming substantially round holes in a circuit board or other board, where each hole has an axis, to hold the connector housing securely to the board, characterized by:

each of said pegs has an axis which can be substantially aligned with the axis of the board hole, a peg body with a periphery and a plurality of ribs extending radially outwardly from said body, with at least a portion of each of said ribs being tapered to be progressively narrower at more radially-outer positions, and with said ribs extending far enough from said peg axis to form an interference fit with the walls of said board hole;

said peg body has a slot extending inwardly from said body periphery to near said axis, and first and second of said ribs lie on said body periphery near opposite sides of said slot, so radially inward forces on said ribs cause said slot to close and allow said ribs to move radially inwardly;

said connector includes a main housing portion which holds a plurality of contacts and which has a lower surface for lying substantially against a surface of said board, said pegs projecting from said lower surface;

said board hole walls are of harder material than said peg ribs;

said board-engaging surface has a recess around the upper end of each of said pegs to provide a space to receive shaved-off rib material.

14. A board and connector combination comprising:

a circuit board having first and second opposite faces and having walls forming a plurality of peg-receiving holes of round cross-section;

a connector having a main housing portion with a lower surface lying substantially facewise against said first board face, and having a plurality of depending pegs lying in said circuit board holes;

each said peg including a peg body having a peg axis, and a plurality of ribs extending generally radially outwardly from said body, with the radially outer ends of said ribs lying on an imaginary circle, with each rib having a narrow radially outer end;

said circuit board being constructed of material, at the walls of said peg-receiving holes, which is of greater hardness than the material of said pegs at said ribs thereof, and the tips of said peg ribs are flattened against the walls of said peg-receiving holes.

* * * * *